United States Patent [19]

Sticher et al.

[11] Patent Number: 4,598,842

[45] Date of Patent: Jul. 8, 1986

[54] SEQUENCED HEATING FOR HOT MELT ADHESIVE DISPENSING SYSTEM

[76] Inventors: Charles K. Sticher, 3784 Whaley Ct., Snellville, Ga. 30278; Charles H. Scholl, 3699 Hermitage Dr., Duluth, Ga. 30136

[21] Appl. No.: 707,090

[22] Filed: Mar. 1, 1985

[51] Int. Cl.[4] ..... B67D 5/62

[52] U.S. Cl. ..... 222/146.5; 222/54; 219/422; 219/425; 425/143

[58] Field of Search ..... 219/425, 422, 421; 222/146.2, 146.5, 54; 239/132, 135; 425/143, 144, 145

[56] References Cited

U.S. PATENT DOCUMENTS

| | | | |
|---|---|---|---|
| 2,658,796 | 11/1953 | Kopperschmidt | 239/132 X |
| 3,408,008 | 10/1968 | Cocks | 222/54 X |
| 4,486,149 | 12/1984 | Merkel | 222/146.5 X |

OTHER PUBLICATIONS

Hot Melts–Uses, Methods, Equipment, Leonard Jaxon,

*Modern Packaging Encyclopedia,* 1971, McGraw-Hill, Inc.

*Primary Examiner*—Joseph J. Rolla
*Assistant Examiner*—Jay I. Alexander

[57] ABSTRACT

A hot melt adhesive dispensing system including a hot melt adhesive dispenser, a hot melt adhesive tank, and a hose for coupling hot melt adhesive from the tank to the dispenser. The dispenser, the tank and the hose are heated by electrical heaters to maintain the adhesive in a suitable molten condition for dispensing and for flowing from the tank to the dispenser. When the hot melt adhesive system is first energized, the hose and tank heaters are coupled to a source of electrical power and the temperature at either the tank or the hose is sensed. When the sensed temperature reaches a suitable preselected level, the dispenser heater is then energized by coupling the heater to a source of electrical power. In this way, as the adhesive in the dispenser is heated from a solid to a molten form, it is free to expand into the hose, with the adhesive in the hose adjacent the dispenser having already been heated to a molten state.

8 Claims, 2 Drawing Figures

SEQUENCED HEATING FOR HOT MELT ADHESIVE DISPENSING SYSTEM

DESCRIPTION OF THE INVENTION

Figure 1:
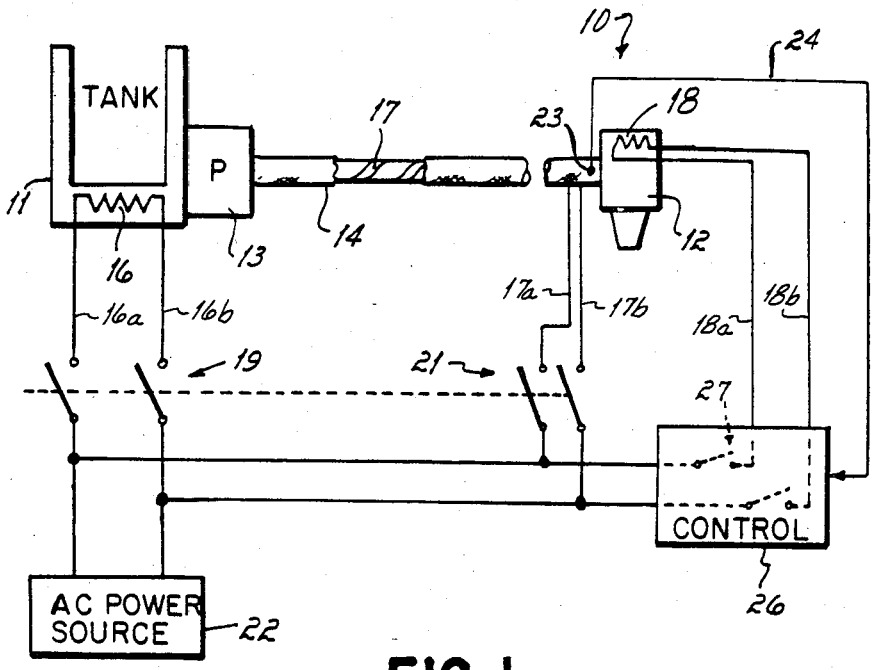

This invention relates generally to hot melt adhesive dispensing systems, and more particularly concerns apparatus and a method for energizing heaters in such systems.

In hot melt adhesive systems, hot melt adhesive is usually heated from a solid state to a molten state for dispensing from a gun, or dispenser, onto a substrate. Upon first use of such a system, adhesive in solid form is usually placed in a tank, which is then heated to heat the adhesive to a molten condition. The molten adhesive is then pumped through a hose or other conduit to a dispensing gun. Typically, the molten adhesive is provided to the gun under pressure and the dispensing of the adhesive is accomplished by opening a valve, permitting release of the adhesive from the gun.

In such systems, in order to maintain the adhesive in a suitably molten condition for dispensing, the hose and the dispensing gun are heated so that the adhesive does not cool down after leaving the heated tank. Normally, in the use of such hot melt adhesive systems, when the system is turned off, such as after a work shift or at the end of a work day, the tank, hose and dispenser heaters are turned off, and the adhesive therein cools to a solid form. When the hot melt adhesive system is again used, all of the heaters are simultaneously energized, usually under thermostatic control, to establish a set point temperature for the system. In one other known system of this type, the tank heater is first energized, and the hose and gun heaters subsequently turned on when the temperature at the tank is near a set point operating value.

In operating hot melt adhesive dispensing systems of the general type outlined above, it has been noted that there is some "drooling" of adhesive from the area of the dispensing valve, and the associated dispenser nozzle, upon reheating the system after a period of non-use. It has also been noted that the seals in and associated with the dispensing gun enjoy a somewhat limited life.

It is the general aim of the present invention in hot melt adhesive dispensing systems of the foregoing type, to reduce or eliminate such "drooling" from the gun nozzle upon reheat, and to reduce stresses on the gun seals in order to prolong the seal life.

These objectives have been accomplished in accordance with certain principles of the invention by providing a hot melt adhesive system in which the adhesive dispenser is heated only after the initiation of heating of the adhesive which is coupled to the dispensing gun, so that adhesive adjacent the gun reaches a molten condition prior to the melting of adhesive in the gun. In a particular embodiment of the invention to be described herein, a heated hose couples adhesive to the dispensing gun, and a heater in the dispenser is energized, after the energization of a heater in the hose, when the temperature at the hose has reached a selected level.

A number of advantages arise from the sequential energization of the heaters in a hot melt adhesive system as described above. One advantage is a reduction in "drooling" from the gun nozzle during reheating of a hot melt adhesive dispensing system. If the system heaters are sequentially activated so that adhesive in the hose leading to the dispensing gun is in a molten condition before the melting of adhesive in the dispenser, expansion of the heated adhesive in the dispenser can be accommodated, or relieved, by permitting expansion of the dispenser adhesive into the hose.

A related advantage of the present invention is the ability to reduce the spring force of a spring loaded valve in the dispensing gun nozzle. In the past, a primary force to be overcome in keeping the nozzle closed has been the expansion force produced by reheating adhesive in the dispenser. If the expansion forces produced by melting the adhesive "trapped" in the dispensing gun is eliminated, the valve spring force can be reduced to the level required to maintain the nozzle closed under normal system operating pressures.

It has also been found that in hot melt adhesive systems employing the invention, the life of seals in and associated with the gun is increased. This is apparently due to the reduction of recurring expansion pressure forces within the gun during reheating.

Figure 2:
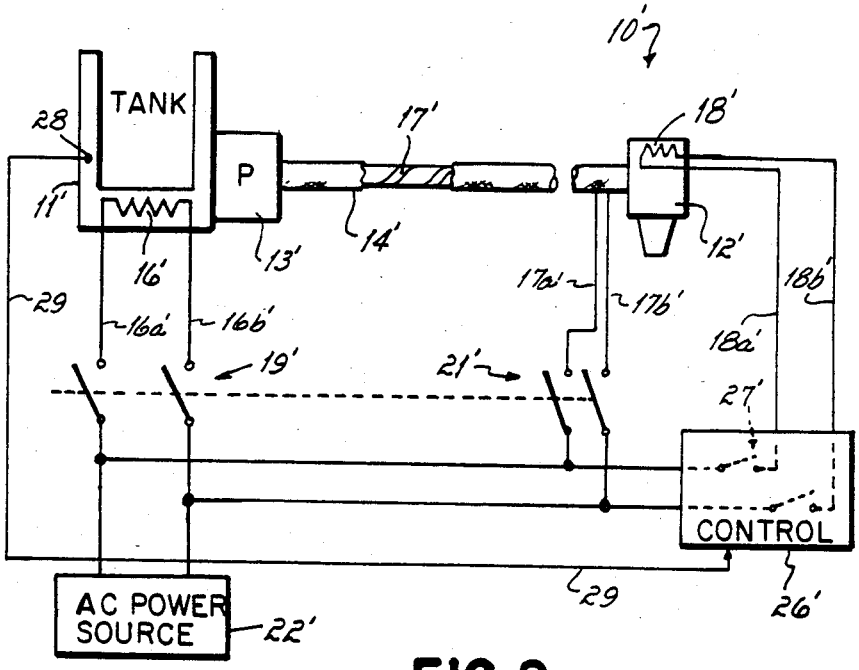

Other objects and advantages of the invention, and the manner of their implementation, will become apparent upon reading the following detailed description and upon reference to the drawings, in which:

FIG. 1 is a diagrammatic illustration of a hot melt adhesive dispensing system in accordance with the present invention; and FIG. 2 is a diagrammatic illustration of a modified form of the system of FIG. 1.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention, as defined by the appended claims.

With reference now to FIG. 1, a hot melt adhesive system 10 includes a tank 11 for holding a supply of hot melt adhesive, which is coupled to a dispenser 12 by a pump 13 through a hose 14.

In order to heat the hot melt adhesive from a solid to a molten state, the tank 11 includes a heater 16, the hose 14 includes heating tape 17, and the dispenser 12 includes a heater 18. The heaters 16–18 are preferably thermostatically controlled to maintain the tank 11, the hose 14, and the dispenser 12 at a set point temperature of, for example, 350° F.

When the system 10 is energized, such as when it is restarted following a period of non-use, the heaters 16 and 17 in the tank and hose, respectively, are energized by closing heater power switches 19 and 21. Closing the switches 19 and 21 couples the heaters 16 and 17 to a source 22 of electrical power via power lines **16*a*, 16*b* and 17*a*, 17*b*. As the solid adhesive in the tank 11 and in the hose 14 is heated toward the system set point temperature, the temperature at the hose 14 is measured by a temperature sensor 23. A signal indicative of the temperature sensed by the sensor 23 is coupled on a line 24 to a control circuit 26, which controls the application of electrical power to the heater 18 in the adhesive dispenser 12. When the hose temperature reaches a suitable level, such as for example 95% of the system set point temperature of 350° F., the signal on line 24 reaches a critical level, initiating the connection of the dispenser heater 18 to the source of electrical power 22**.

In the illustrated control circuit 26, a double pole switch 27 is closed to connect the heater 18 to the source of electrical power via lines 18*a*, 18*b*. In practice, transistor or other semi-conductor switching may be utilized to couple the dispenser heater 18 to a source of electrical power. In its simplest form the control circuit 26 may include a comparator for comparing the temperature signal on the line 24 to a set point value, with the output of the comparator controlling the closing of a solid state switch arrangement 27.

A hot melt adhesive dispensing system 10' substantially the same as that of FIG. 1 is shown in FIG. 2, wherein common elements have been given common numbers, with the addition of a "prime" designation. In the hot melt adhesive system 10' of FIG. 2, the temperature sensor 23 in the hose 14 has been replaced by a temperature sensor 28 in the tank 11'. The output of the temperature sensor 28 is coupled on a line 29 to the control 26', which functions in the same manner as the control 26 in the system 10 of FIG. 1.

In some practical hot melt adhesive systems, it is advantageous to sense the tank temperature rather than the hose temperature in order to avoid the need to attach a temperature sensor to the hose 14'. In some cases, multiple hoses are coupled to the same tank, and a single temperature sensor 28 may serve in place of a number of temperature sensors 23, which would be required if the hose temperature were sensed. Also, replacement of hoses in the system is a more common occurrence than replacement of the tank, so that using a tank temperature sensor reduces the frequency of sensor replacement.

While measuring the temperature at the tank is less precise in assuring melting of adhesive in the hose than is measuring the hose temperature, it has been found that suitable performance can be obtained by noting the correlation for a given type of system between the heating of the hose and the heating of the tank.

In one specific form of the system 10' of FIG. 2, the tank heater 16' and the hose heater 17' are energized and the temperature at the tank 11' is sensed by a sensor 28. When the sensed temperature, as indicated by the sensor signal on the line 29, reaches 95% of the system set point temperature of 350° F., the control 26' energizes the dispenser heater 18'. In this system the adhesive in the hose 17' adjacent the dispenser 12' melts before the melting of adhesive in the dispenser itself.

What is claimed is:

1. A hot melt adhesive dispensing system comprising a hot melt adhesive dispenser, a hot melt adhesive tank, means for coupling hot melt adhesive to the dispenser from the tank, a dispenser heater for heating hot melt adhesive in the dispenser, a tank heater for heating hot melt adhesive in the tank, a third heater for heating hot melt adhesive intermediate the tank and the dispenser, means for coupling the tank heater and the third heater to a source of power to energize the tank heater and the third heater, means for sensing the temperature at the tank, and means, responsive to said temperature sensing means, for coupling the dispenser heater to a source of power to energize the dispenser heater when said temperature sensing means senses a selected temperature at the tank.

2. The hot melt adhesive dispensing system of claim 1 in which the selected temperature is a selected proportion of an operating temperature of the hot melt adhesive dispensing system.

3. A hot melt adhesive dispensing system comprising a hot melt adhesive dispenser, a hose for coupling hot melt adhesive from a source of hot melt adhesive to the dispenser, a hose heater for heating the hose, a dispenser heater for heating the dispenser, means for coupling the hose heater to a source of power to energize the hose heater, temperature sensing means for sensing the temperature at the hose, and means, responsive to said temperature sensing means, for coupling the dispenser heater to a source of power to energize the dispenser heater when said temperature sensing means senses a selected temperature at the hose.

4. The hot melt adhesive dispensing system of claim 3 in which the selected temperature is a selected proportion of an operating temperature of the hot melt adhesive dispensing system.

5. The hot melt adhesive dispensing system of claim 3 which further comprises a hot melt adhesive tank serving as a source of hot melt adhesive, the hose coupling hot melt adhesive from the tank to the dispenser.

6. The method of heating a hot melt adhesive dispensing system which includes a tank for hot melt adhesive coupled to a dispenser for hot melt adhesive comprising the steps of:

(a) heating the tank and heating hot melt adhesive intermediate the tank and the dispenser;

(b) sensing the temperature at the tank; and (c) heating the dispenser when the temperature sensed at the tank reaches a selected level.

7. The method of heating a hot melt adhesive dispensing system which includes a hot melt adhesive dispenser and a hot melt adhesive hose for coupling adhesive from an adhesive source to the dispenser, comprising the steps of:

(a) heating the hose;

(b) sensing the temperature at a selected location in the hot melt adhesive dispensing system; and (c) heating the dispenser when the sensed temperature reaches a level such that adhesive in the hose adjacent the dispenser reaches a molten condition before adhesive in the dispenser reaches a molten condition.

8. The method of claim 7 in which the step (b) comprises sensing the temperature at the hose, and the step (c) comprises heating the dispenser when the temperature sensed at the hose has reached a selected level.

* * * * *

UNITED STATES PATENT AND TRADEMARK OFFICE

CERTIFICATE OF CORRECTION

PATENT NO. : 4,598,842

DATED : July 8, 1986

INVENTOR(S) : Charles K. Sticher et al

It is certified that error appears in the above-identified patent and that said Letters Patent is hereby corrected as shown below:

In the preamble, the assignment information should read as follows:

--Assignee: Nordson Corporation, Amherst, Ohio--

Signed and Sealed this

Eighth Day of September, 1987

*Attest:*

*Attesting Officer*

DONALD J. QUIGG

*Commissioner of Patents and Trademarks*